US010319361B2

(12) United States Patent
Clemow

(10) Patent No.: US 10,319,361 B2
(45) Date of Patent: Jun. 11, 2019

(54) DIGITAL CIRCUIT ARRANGEMENTS FOR AMBIENT NOISE-REDUCTION

(71) Applicant: Cirrus Logic International Semiconductor Ltd., Edinburgh (GB)

(72) Inventor: Richard Clemow, Gerrards Cross (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/383,839

(22) Filed: Dec. 19, 2016

(65) Prior Publication Data

US 2017/0103746 A1 Apr. 13, 2017

Related U.S. Application Data

(63) Continuation of application No. 14/142,329, filed on Dec. 27, 2013, now Pat. No. 9,558,729, which is a (Continued)

(51) Int. Cl.
*H04R 1/10* (2006.01)
*H04R 3/02* (2006.01)

(Continued)

(52) U.S. Cl.
CPC ..... *G10K 11/178* (2013.01); *G10K 11/16* (2013.01); *H04R 1/1083* (2013.01); *H04R 3/02* (2013.01);

(Continued)

(58) Field of Classification Search
None
See application file for complete search history.

(56) References Cited

U.S. PATENT DOCUMENTS 4,455,675 A 6/1984 Bose et al.
4,480,333 A 10/1984 Ross (Continued)

FOREIGN PATENT DOCUMENTS

DE 195 26 098 9/1996
EP 0 390 386 10/1990

(Continued)

OTHER PUBLICATIONS

Devices, Analog. "Sigma Delta ADCs and DACs." Application note AN-283 (1999).*

(Continued)

*Primary Examiner* — Curtis A Kuntz
*Assistant Examiner* — Kenny H Truong
(74) *Attorney, Agent, or Firm* — Blank Rome LLP

(57) ABSTRACT

A digital circuit arrangement for an ambient noise-reduction system affording a higher degree of noise reduction than has hitherto been possible. The arrangement converts the analog signals into N-bit digital signals at sample rate $f_0$, and then subjects the converted signals to digital filtering. The value of N in some embodiments is 1 but, in any event, is no greater than 8, and $f_0$ may be 64 times the Nyquist sampling rate but, in any event, is substantially greater than the Nyquist sampling rate. This permits digital processing to be used without incurring group delay problems that rule out the use of conventional digital processing in this context. Furthermore, adjustment of the group delay can readily be achieved, in units of a fraction of a micro-second, providing the ability to fine tune the group delay for feed forward applications.

6 Claims, 10 Drawing Sheets

Related U.S. Application Data continuation of application No. 13/416,707, filed on Mar. 9, 2012, now Pat. No. 8,644,523, which is a continuation of application No. 12/295,709, filed as application No. PCT/GB2007/001344 on Apr. 11, 2007, now Pat. No. 8,165,312.

(51) Int. Cl.
*G10K 11/16* (2006.01)
*G10K 11/178* (2006.01)

(52) U.S. Cl.
CPC ..... *G10K 2210/1081* (2013.01); *G10K 2210/3051* (2013.01); *G10K 2210/3217* (2013.01)

(56) References Cited

U.S. PATENT DOCUMENTS

| | | | | |
|---|---|---|---|---|
| 5,134,659 | A | 7/1992 | Moseley | |
| 5,138,663 | A | 8/1992 | Moseley | |
| 5,138,664 | A | 8/1992 | Kimura et al. | |
| 5,196,852 | A | 3/1993 | Galton | |
| 5,241,310 | A | 8/1993 | Tiemann | |
| 5,311,453 | A | 5/1994 | Denenberg et al. | |
| 5,319,715 | A | 6/1994 | Nagami et al. | |
| 5,410,605 | A | 4/1995 | Sawada et al. | |
| 5,475,761 | A | 12/1995 | Eatwell | |
| 5,481,615 | A | 1/1996 | Eatwell et al. | |
| 5,621,803 | A | 4/1997 | Laak | |
| 5,754,592 | A | 5/1998 | Flowers et al. | |
| 5,838,272 | A | 11/1998 | Steiner et al. | |
| 5,852,667 | A * | 12/1998 | Pan ..... | G10K 11/1784 381/71.1 |
| 5,870,048 | A | 2/1999 | Kuo et al. | |
| 5,937,070 | A | 8/1999 | Todter et al. | |
| 5,982,313 | A | 11/1999 | Brooks | |
| 6,118,878 | A | 9/2000 | Jones | |
| 6,181,753 | B1 | 1/2001 | Takada et al. | |
| 6,249,237 | B1 | 6/2001 | Prater | |
| 6,326,912 | B1 | 12/2001 | Fujimori | |
| 6,449,369 | B1 | 9/2002 | Carme et al. | |
| 6,549,586 | B2 | 4/2003 | Gustafsson et al. | |
| 6,717,991 | B1 | 4/2004 | Gustafsson et al. | |
| 6,937,738 | B2 | 8/2005 | Armstrong et al. | |
| 6,950,049 | B2 | 9/2005 | Brooks et al. | |
| 6,996,241 | B2 | 2/2006 | Ray et al. | |
| 7,103,188 | B1 | 9/2006 | Jones | |
| 7,274,716 | B2 | 9/2007 | Hochschild | |
| 7,365,669 | B1 | 4/2008 | Melanson | |
| 7,386,142 | B2 | 6/2008 | Kindred | |
| 7,592,941 | B2 | 9/2009 | Ohkuri et al. | |
| 7,630,504 | B2 | 12/2009 | Poulsen | |
| 7,653,204 | B2 | 1/2010 | Chen et al. | |
| 7,889,108 | B2 | 2/2011 | Hamashita et al. | |
| 8,054,992 | B2 | 11/2011 | Sapiejewski | |
| 8,094,046 | B2 | 1/2012 | Asada et al. | |
| 8,472,636 | B2 | 6/2013 | Sibbald | |
| 2002/0141599 | A1 | 10/2002 | Trajkovic | |
| 2002/0176584 | A1 | 11/2002 | Kates | |
| 2003/0228019 | A1 | 12/2003 | Eichler et al. | |
| 2003/0235315 | A1 | 12/2003 | Reesor | |
| 2004/0258103 | A1 | 12/2004 | Hochschild | |
| 2004/0264706 | A1 | 12/2004 | Ray et al. | |
| 2005/0220185 | A1 | 10/2005 | Dowling | |
| 2005/0265568 | A1 | 12/2005 | Kindred | |
| 2006/0038709 | A1 | 2/2006 | Lu et al. | |
| 2007/0127761 | A1 | 6/2007 | Poulsen | |
| 2008/0212791 | A1 | 9/2008 | Asada et al. | |
| 2008/0253594 | A1 | 10/2008 | Rasmussen et al. | |
| 2009/0034748 | A1 | 2/2009 | Sibbald | |
| 2009/0046867 | A1 | 2/2009 | Clemow | |
| 2010/0183168 | A1 | 7/2010 | Michiyoshi | |
| 2011/0129098 | A1 | 6/2011 | Delano | |
| 2011/0142247 | A1 | 6/2011 | Fellers et al. | |

FOREIGN PATENT DOCUMENTS

| | | |
|---|---|---|
| EP | 0 578 212 | 1/1994 |
| EP | 0 654 901 | 5/1995 |
| EP | 1 074 971 | 2/2001 |
| GB | 2 274 372 | 7/1994 |
| JP | 5-36991 | 5/1993 |
| JP | 7-66687 | 3/1995 |
| JP | 11-126082 | 5/1999 |
| JP | 2002-76902 | 3/2002 |
| JP | 2005-151184 | 6/2005 |
| WO | WO 94/07212 | 3/1994 |
| WO | WO 97/02559 A1 | 1/1997 |
| WO | WO 97/42714 | 11/1997 |
| WO | WO 03/003789 | 1/2003 |

OTHER PUBLICATIONS

E. Pfann; "Design and Analysis of Oversampled ΣΔ Adaptive LMS Filters"; Dissertation submitted to Dept of Electronic and Electrical Eng, Univ of Strathclyde, Published Nov. 2002.

P. Minogue et al., "Adaptively Cancelling Server Fan Noise: Principles and Experiments with a Short Duct and the AD73522 dspConverter," *Analog Dialogue Magazine*, 2000, vol. 34, pp. 10-15.

L. Lin et al., "Adaptive Signal Processing in Subbands Using Sigma-Delta Modulation Technique," *IEEE International Conference of Acoustics, Speech and Signal Processing*, 1994, vol. 3, pp. 169-172.

* cited by examiner

DIGITAL CIRCUIT ARRANGEMENTS FOR AMBIENT NOISE-REDUCTION

This is a continuation of application Ser. No. 14/142,329, filed Dec. 27, 2013, which is a continuation of application Ser. No. 13/416,707, filed Mar. 9, 2012, now U.S. Pat. No. 8,644,523, which is a continuation of application Ser. No. 12/295,709, filed Oct. 1, 2008, now U.S. Pat. No. 8,165,312, which is a 371 of International Application No. PCT/GB2007/001344, filed Apr. 11, 2007, the disclosures of which are incorporated herein by reference in their entireties.

The present invention relates to digital circuit arrangements for use in, or as incorporated in, ambient noise-reduction control systems, primarily for use with earphones; a term intended as used herein to encompass generally devices incorporating a loudspeaker for use in, or in close proximity to, the ear; thereby including headphones and telephone handsets as well as devices directly supported in or on the ear itself. The invention has especial, though not exclusive, application to earphones intended for use in conjunction with portable electronic devices, such as personal music players and cellular phones.

At present, some earphones are wired directly to their sound source via short leads and connectors, and some are connected via wireless links, such as the "Bluetooth" format, to a local sound generating device, such as a personal music player or cell-phone. The present invention can be used with both wired and wireless formats.

It is further important to note that existing ambient noise-reduction systems for earphones are based on either one of two entirely different principles, namely the "feedback" method, and the "feed-forward" method.

The feedback method, described for example in U.S. Pat. No. 4,455,675, is based upon the use of a sealed-cavity earphone; i.e. one in which an earphone shell encloses the ear of a listener and effectively seals out some at least of the ambient noise. A typical feedback system is shown schematically in FIG. 1*a*, to which reference will now be made. Inside a cavity 11 that is formed between the ear and the inside of an earphone shell 12, a miniature microphone 13 is placed directly in front of the earphone loudspeaker 14. Output signals from the microphone 13 are coupled back to the loudspeaker 14 via a negative feedback loop 15 including an inverting amplifier 16, so as to form a simple servo system in which the loudspeaker 14 is constantly attempting to create a null sound pressure level at the microphone 13. Although this principle is simple, its practical implementation presents certain difficulties.

One of these difficulties arises because the intrinsic phase response of the loudspeaker and the propagation delay between the speaker and microphone both introduce phase lags at higher frequencies. When the resultant phase lag becomes equal to, or greater than, one half of a wavelength, the feedback system is no longer negative but positive, creating instability which results in continuous, massive oscillation. Accordingly, high-frequency (HF) filtering must be incorporated into the feedback loop, imposing severe restrictions upon the upper frequency of operation and typically limiting its effectiveness to frequencies of about 1 kHz or below. Further difficulties arise when feedback systems incorporate an input for sounds, such as music, intended for the listener's attention because the feedback loop needs to be configured such that such sounds are not cancelled. In practice, therefore, although ambient noise reduction systems of the feedback kind can be used with a music or other input, significant limitations are imposed upon the frequency range over which noise reduction is achievable.

In any event, it is important to note that any electronic time delay in the feedback loop will worsen this problem by reducing the frequency at which the oscillation occurs, which in turn reduces the usable frequency range of the earphones. It is therefore necessary to minimise the group delay of the electronic feedback loop. To obtain good performance, a key requirement is the provision of an electronic filter in series with the inverting amplifier, the filter having specific amplitude and phase responses, and low group delay.

The feed-forward method is disclosed, for example, in U.S. Pat. No. 5,138,664 and a typical feed-forward system is depicted in basic form in FIG. 1*b*; the FIG. 1*b* system being shown to include an input for music or other sounds intended for the listener's attention, since it is relatively easy to discriminate between the ambient noise to be reduced and the music or other signals in feed-forward systems. In contrast to the feedback system, a microphone 23 is placed on the exterior of the headphone shell 22 in order to detect the ambient noise signal on its way into the earphone. The detected signal is pre-amplified and inverted in a suitable inverting amplifier 27 and added at 28 to the earphone drive signal, supplied to the combining circuit 28 by way of a buffer amplifier 29, which is fed by way of a drive amplifier 30 to an earphone loudspeaker 24, thus creating a composite signal S containing a music component and a noise reduction signal component. As a consequence, destructive wave reduction occurs between the noise reduction signal component of the composite signal S and the incoming ambient acoustic noise signal, adjacent to the outlet port of the loudspeaker 24, within a cavity 21 formed between the headphone shell 22 and the outer ear. For this to occur, the noise reduction component of the composite signal S must have a magnitude which is substantially equal to that of the incoming noise signal, and it must be of substantially opposed polarity (that is, inverted, or 180° shifted in phase with respect to the noise signal).

This requirement must be met across as wide a frequency band as possible to obtain good results. Again, a key requirement is the provision of an electronic filter in series with the inverting amplifier; the filter having specific amplitude and phase responses such that the acoustic cancellation signal is as close as possible to that required for perfect acoustic cancellation. It follows that the timing of the cancellation signal must be correct relative to the ambient acoustic signal, or in other words the group delay of the electronic filter must be correct. If this delay is too small or too large, cancellation will be impaired.

Referring to FIG. 2, which shows the earphone of FIG. 1*b* and indicates schematically a path that can be followed by ambient noise on its way into the ear, the overall acoustic noise path to the listener's ear drum includes path sections A, B and C, whereas the cancellation signal path consists of acoustic paths A and C, in addition to the electronic path from the microphone 21 to the speaker 24 via the electronic filter. It follows that the group delay of the electronic path must be equal to the delay of the acoustic path B to obtain optimal cancellation. Substantial equality of these parameters can be achieved by careful positioning of the microphone, taking into account the characteristics of the specific components employed in the electronic path. However, if any of the components is changed, or the physical acoustic arrangements are altered, it may be necessary to reposition the microphone, which may require a product re-design. It is therefore highly desirable not only to minimise the group delay of the processing chain, but also to provide a means of introducing a controlled amount of group delay in the electronic filter so that it is easy to adjust the delay to the required value if other aspects of the system are changed. This is impractical for analogue electronic filters, so the designer must resort to careful microphone positioning.

In practice, with feed-forward systems, it is generally preferred to employ more than one microphone such as 23, strategically placed in a predetermined array relative to the earphone shell 22 (usually close to the periphery of the shell) and to merge their respective outputs to achieve a desired directionality performance. The use of a single microphone, however, is viable in some circumstances and, in any event, serves for the present description.

It can be seen from the foregoing that, in order to obtain good performance either from the feed-forward or from the feedback arrangement, a key requirement is the provision of an electronic filter having specific amplitude and phase responses such that the acoustic cancellation signal is as close as possible to that required for perfect acoustic cancellation. Crucially, the electronic filter should have a very small group delay. Preferably, in particular for a feed-forward arrangement, the group delay should be easily adjustable.

The applicant's co-pending UK patent application No. GB 0601536.6 and counterpart international patent application No. PCT/GB2007/000120 describe the significance of an error in the group delay in a feed-forward system. For example, it is shown therein that, in order to achieve a noise cancellation performance of 12 dB at 1 kHz, the electronic filter group delay must be within 40 micro-seconds of the correct value.

Additionally, for both the feed-forward and feedback arrangements, the filter needs to take into account the acoustic criteria and all of the other electronic components in the circuit, and this further complicates the filter design. Furthermore, whilst the design of a filter having the required amplitude and phase characteristics is intrinsically difficult, as noted above, it is nearly impossible to achieve with a cost-effective number of components. The required components tend to comprise expensive and bulky items manufactured to close tolerances, further increasing costs. Application-specific integrated circuits (ASICs) may be considered, but a number of external components are still required, and development cost of the ASIC is difficult to justify.

All of the foregoing factors militate against the use of analogue filters, and it is thus attractive in principle to consider the use of digital filtering technology. However, any conventional application of digital processing presents serious difficulties as regards the group delay imposed by the system; a factor which, as already explained, is critical in the current context. The origins of such difficulty will be explained in more detail below.

The straightforward use of digital processing technology is further disadvantageous in that conventional processors require components such as decimating filters and interpolating filters which operate at high bit levels and/or extremely high clocking rates, imposing power requirements and operational factors such that it could be reasonably concluded that digitally implemented filter circuits are not feasible for use in ambient noise-reduction systems for earphones.

Accordingly there is a need for a digital processing circuit arrangement, suitable for use in an ambient noise-reduction system and which addresses one or more of the aforementioned difficulties and drawbacks associated with the use of analogue filter circuits and conventional digital filter circuits.

According to the invention there is provided a digital circuit arrangement for receiving analogue electrical signals indicative of ambient noise and for performing a filtering operation upon said analogue signals; the arrangement comprising means for converting said analogue signals into N-bit digital signals at sample rate $f_0$, digital means for effecting said filtering operation and digital delta-sigma modulator means; where N is no greater than 8 and $f_0$ is substantially greater than the Nyquist sampling rate (the Nyquist sampling rate being twice the required analogue audio bandwidth).

It has been found in practice that increasing the value of N beyond 8 incurs significant additional expense without corresponding benefit in performance.

Preferably N is 5 or less and $f_0$ is at least 8 times the Nyquist sampling rate. It is particularly preferred that N equals 1 and/or $f_0$ is 64 times the Nyquist sampling rate.

In some preferred embodiments, the delay imparted by the arrangement as a whole to signals processed thereby is advantageously readily adjustable, for example by changing the operational clocking rate, or preferably by utilising a shift register, a chain of D-type flip-flops, or a cyclic memory buffer with read and write addresses which are offset by the required delay.

It is further preferred in some embodiments of the invention that an output DAC is configured to directly drive a loudspeaker via switching transistors.

Preferably, the processing function comprises at least one IIR filter.

In some preferred embodiments, the filter incorporates a high-pass filter to remove very low frequency ambient noise signals.

In some embodiments, it is preferred that the filter incorporates a low-pass filter to roll off the noise cancelling effect at higher frequencies.

It is convenient in some embodiments to combine a plurality of filters into a single, more complex, filter function A preferred implementation of an arrangement according to the invention comprises a noise reduction system comprising microphone means to generate electrical signals indicative of said ambient noise, an arrangement according to the invention configured to operate upon said electrical signals, and a loudspeaker disposed to project sound into the ear of a listener; the circuit arrangement being adapted to supply driving signals to the loudspeaker.

In some preferred embodiments, such an implementation is incorporated into a feedback noise reduction system and in other preferred embodiments the implementation is incorporated into a feed-forward noise reduction system.

In still further embodiments, the filter of the arrangement is supplied with first and second inputs and includes a mixing function; said first input being derived from an external microphone forming part of a feed-forward system and said second input being derived from an internal microphone forming part of a feedback system.

In several embodiments of the invention there is preferably additionally provided means for receiving further sound signals intended to be heard by the listener, such as music signals from any convenient source and/or speech signals from a mobile telephone, and for conveying said further sound signals, or signals derived therefrom, to the listener.

In some embodiments, the filter incorporates filter means specifically designed to compensate for a non-flat low-frequency amplitude and phase loudspeaker response in the 20-500 Hz region.

Some particularly preferred forms of the invention comprise further digital processing, adapted, for example, to permit adjustment of the degree of noise reduction.

Some embodiments of the invention can benefit from implementation in the form of an application-specific integrated circuit.

In order that the invention may be clearly understood and readily carried into effect, embodiments thereof will now be described; by way of example only, with reference to the accompanying drawings, of which:

FIG. 1*a* has already been referred to, and is a diagram explanatory of the feedback type of ambient noise reduction system;

FIGS. 1*b* and 2 also have been referred to already, and comprise diagrams explanatory of the feed-forward type of ambient noise reduction system;

Figure 1B:
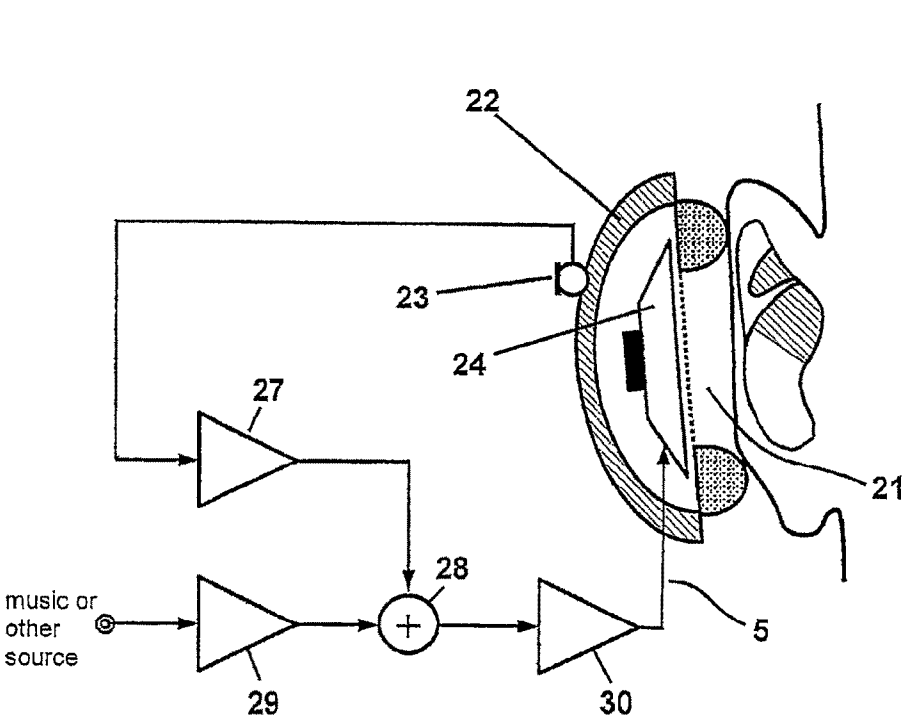
Fig 1b PRIOR ART

Before describing embodiments of the invention in detail, some further background information will be provided in relation to the difficulties facing the designer of a filter circuit for use in the present context.

As mentioned briefly above it is necessary, in designing filters for both the feed-forward and feedback systems, to take into account the acoustic arrangements and all of the other electronic components in the circuit. Two of these elements in particular complicate the design of the filter:

The characteristics of the electro-mechanical speaker are complex and it is difficult to design analogue filters to compensate for these characteristics below a few hundred Hz.

Common microphone types have a low-frequency response that extends down to a few Hz or below. A high-pass filter may be required to prevent large amplitude very low frequency acoustic signals picked up by the microphone from driving the electronics into saturation. This filter can take the form of a simple RC circuit, but such circuits do not have a sufficiently steep cut-off to avoid adversely affecting the filter response for the lower audible frequencies it is desired to cancel. The phase response is particularly badly affected by such circuit elements.

The electronic filter therefore needs to have a complex amplitude and phase response. In practice, all commercial consumer noise reducing headphones use an analogue electronic filter (if any filter is used at all). However, the filter is often far from perfect, as the design of an analogue filter with the required amplitude and phase characteristics is difficult, as noted above, and nearly impossible to achieve with a cost-effective number of components. In order to ensure manufacturability, close tolerance components may also have to be used, further increasing costs. To achieve some of the required low-frequency filter response shaping, large capacitors may be required. These are relatively expensive and bulky. For mass-produced products, an application-specific integrated circuit (ASIC) can be used to reduce component costs, but a number of external components are still required, and development cost of the ASIC is difficult to justify. This assertion is borne out by the fact that no currently available commercial consumer noise reduction system for earphones uses a custom ASIC to implement the filter.

Against the foregoing background, it is attractive to consider the use of digital filtering technology, particularly when it is considered that digital filters are well known for their ability to implement almost any required filter response in an accurate, repeatable, stable and cost-effective way. Digital ASICs can be produced at very low cost and require few, if any, external components. Moreover, if digital technology is used, it also becomes relatively easy to add advanced control features, or to integrate the noise-cancellation circuit with other functions, such as an MP3 player or music enhancement algorithm. A still further advantage of using digital technology is that it can readily be configured for different acoustic arrangements with a read-only data memory, for example. In contrast, analogue circuits require many component changes, or a re-design, to suit different acoustic arrangements. Digital processing therefore has many advantages over analogue for this application.

Figure 3:
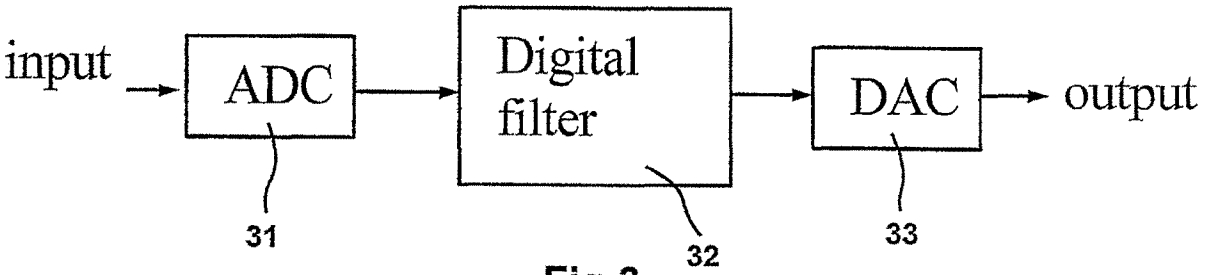
FIG. 3 shows a conventional electronic filter using digital processing.

However, a conventional application of digital processing presents serious difficulties as regards the group delay imposed by the system. This is explained with reference to FIG. 3, which shows schematically an arrangement consisting of an analogue-to-digital converter (ADC) 31, a digital filter 32, and a digital-to-analogue converter (DAC) 33. The ADC 31 and DAC 33 must be clocked at a minimum of twice the maximum audio frequency to be accommodated (as dictated by the Nyquist criterion), so the minimum clock frequency for a system designed to cancel noise up to 5 kHz, for example, is 10 kHz. The major difficulty with such an arrangement in the present application is that each of the elements in the filter introduces a significant delay, contributing to an overall delay which is known as the "group" delay. The importance of avoiding the introduction of additional delay into feedback and feed-forward systems used in this context has been emphasised in the foregoing and, although the use of higher sampling rates can somewhat reduce the delay, they are still excessive, even if a typical audio sampling rate of 48 kHz is employed.

There are various ADC and DAC technologies known, but most audio quality converters are of the so-called "delta-sigma" type. A typical example of an ADC is the AD1870 from Analog Devices Inc., which exhibits a group delay of 750 micro-seconds at a sampling rate of 48 kHz; this delay being of itself almost twenty times the example target of 40 micro-seconds, referred to above for a feed-forward system. Delta-sigma DAC converters have similar group delays. Faster converter technologies exist, including the "flash" type of converter, but these are prohibitively expensive. Irrespective of how low the ADC and DAC delays can be made, however, the digital filter 32 has a group delay which alone is too high. A typical digital filter incurs a few audio samples of delay, the delay being larger for more complex filter shapes. Even a simple $5^{th}$ order 48 kHz digital filter, with a 5-sample delay, incurs a delay of approximately 100 micro-seconds. The group delay of the whole processing chain is thus typically 750 micro-seconds (attributable to the ADC 31) plus 100 micro-seconds (attributable to the digital filter 32) plus 750 micro-seconds (attributable to ADC 33) amounting to some 1600 micro-seconds, which is around 40 times too large. The only way to reduce the time delay of such a system to acceptable levels would be to use a much higher clock rate. This would not be commercially viable on cost grounds and would increase power consumption; an important consideration for a battery-powered application. Accordingly there is, to the Inventor's knowledge, no current commercial consumer noise-cancelling earphone system using a digital filter for the purpose of performing direct cancellation.

It should be noted that digital processing is used in some noise-cancelling headphone products but this processing does not attempt to provide cancellation by time alignment of the ambient acoustic signal and the cancellation signal, but invariably operates on repetitive audio signals, providing adaptive filtering, for example using least mean square (LMS) techniques. The group delay problem is not a consideration in those applications, and they are not relevant to the present invention as they do not attempt to directly cancel the noise. Those systems make use of the repetitive nature of noise to predict noise ahead of time, thus overcoming the need for a low group delay. Although such systems can effectively cancel repetitive noise, they fail when the noise is not predictable. The present invention relates to noise cancelling systems that do not rely on the repetitive nature of the noise to operate satisfactorily.

Completely independently of the above discussion, further background concerning digital processing needs to be described in order for the invention to become clear.

Conventional digital audio processing utilises a relatively large number of bits in the ADC, in order to represent the audio signal with sufficient accuracy and to ensure that the quantisation noise is at an adequately low level, allowing the desired signal-to-noise ratio (SNR) to be achieved. 16 or more bits are commonly used for audio to achieve SNR figures in excess of 90 dB. The conventional digital signal processor shown in FIG. 4 consists of a delta-sigma ADC 41, a digital processing circuit (filter) 42, and delta-sigma DAC 43. The digital processing circuit 42 typically operates on 16-bit or 24-bit words and is a very well established technology area.

Figure 5:
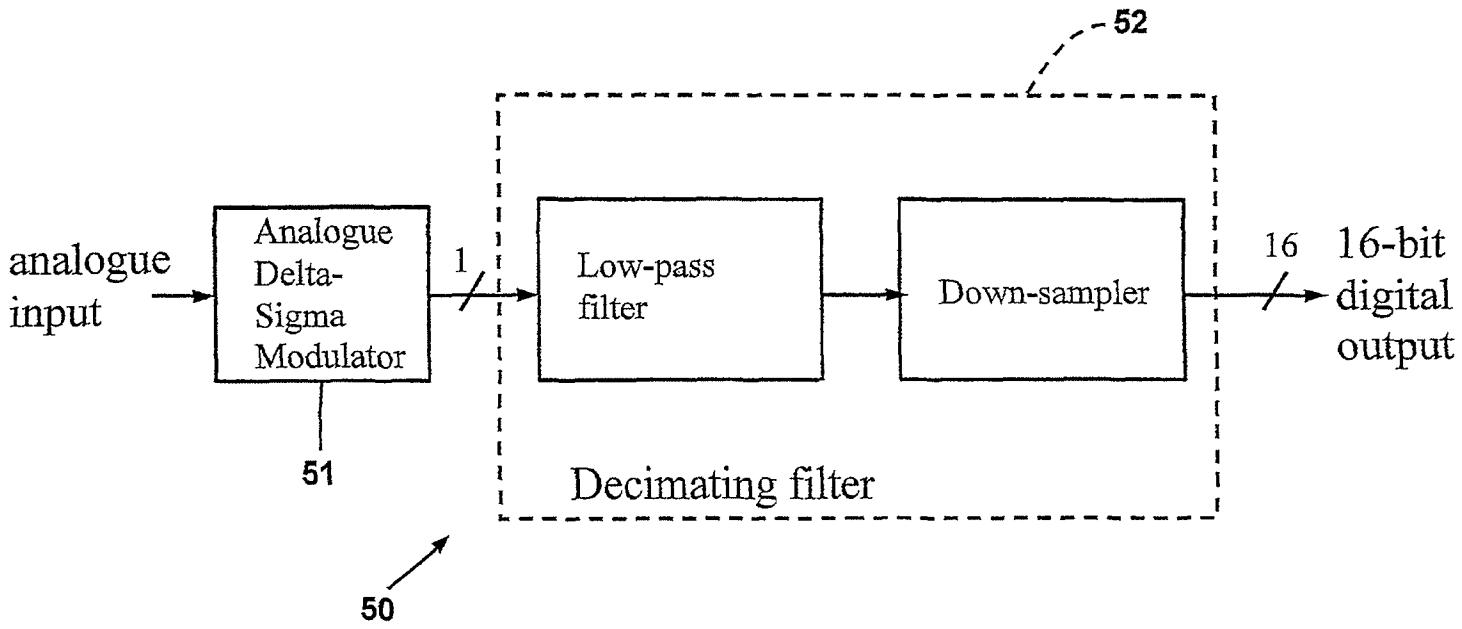
FIG. 5 shows a conventional delta-sigma analogue-to-digital converter.
Figure 6:
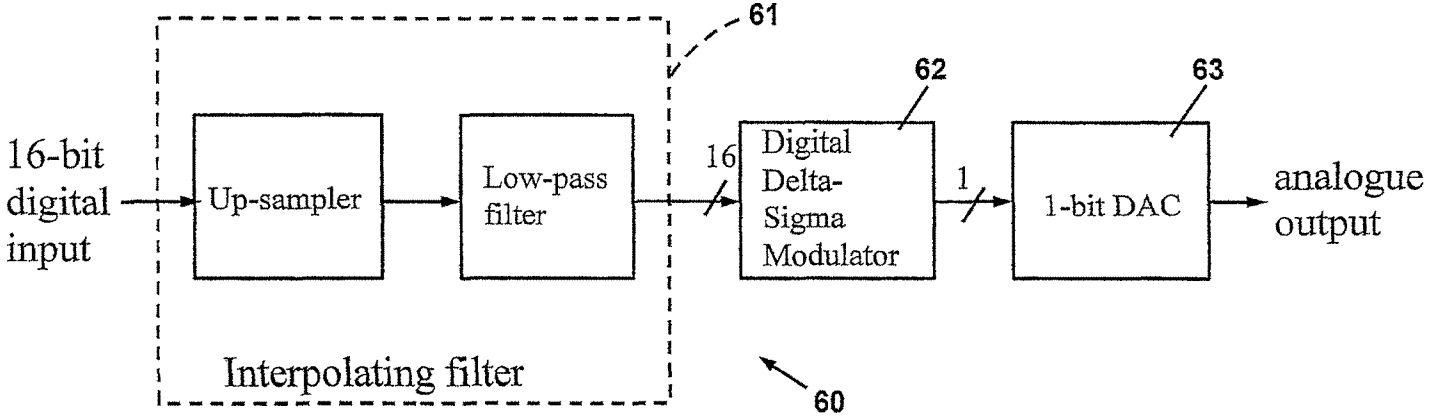
FIG. 6 shows a conventional delta-sigma digital-to-analogue converter.

The internal architectures of the delta-sigma ADC and DAC are shown in FIGS. 5 and 6 respectively. It will be seen that the first part of the ADC 50 is a delta-sigma modulator 51, which feeds a decimating filter 52. The output of the delta-sigma modulator 51 has N bits, where N is typically a relatively small number; preferably in the range from 1 to 5. In this example, 1 bit is used, and the system operates with a relatively high sampling rate which is typically 64 times the required audio sampling rate (the "over-sampling" rate). In order to obtain a good SNR, it is necessary to "shape" the spectrum of the noise at the output of the delta-sigma modulator 51 so that most of the noise falls outside the audio bandwidth. This is a feature of all delta-sigma ADCs. The decimating filter 52 is a digital filter that increases the number of bits to (say) 16 and reduces the sampling rate down to the audio sampling rate.

The DAC 60 consists of an interpolating filter 61, followed by a delta-sigma modulator 62 and N-bit DAC 63, where N is typically 1. The interpolating filter 61 increases the sampling rate to the over-sampling rate.

Figure 4:
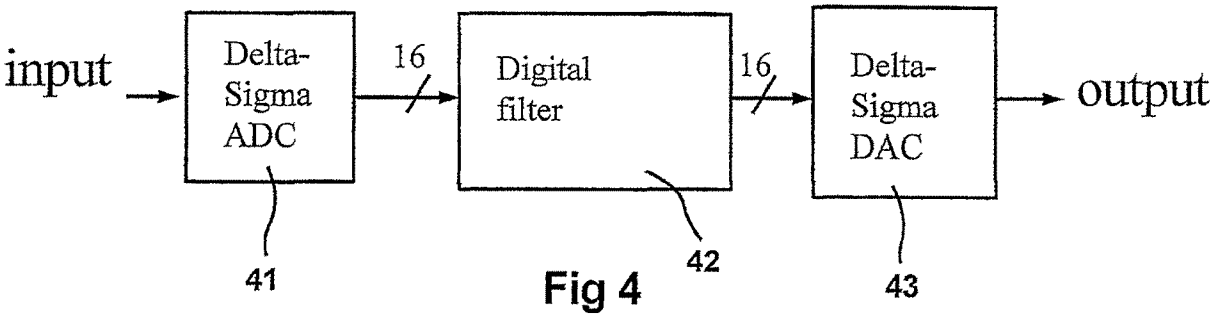
FIG. 4 shows a conventional digital audio processor.
Figure 7:
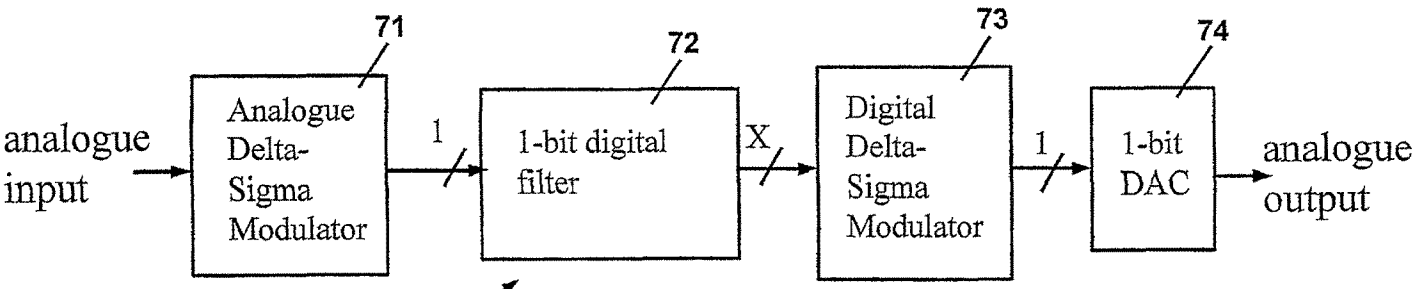
FIG. 7 shows a 1-bit processing system.

Higher audio quality can be achieved by performing the digital processing of FIG. 4 at the over-sampling rate and in the 1-bit domain, as shown in FIG. 7, wherein a signal processing circuit 70 consisting of an analogue delta-sigma modulator 71, 1-bit digital filter 72, digital delta-sigma modulator 73 and 1-bit DAC 74. The circuit 70 operates at the over-sampling rate, and it will be noted that it is equivalent to the front half of a conventional delta-sigma ADC, a 1-bit processor, and the back half of a conventional delta-sigma DAC. It is important to note that the decimating and interpolating filters 52 and 61 are not present.

The output from a 1-bit DAC is simply a signal that switches between two levels, and it can therefore be used to directly drive a loudspeaker, avoiding the need for a linear power amplifier, in a similar way to the well-known Pulse Width Modulated (PWM) Class D amplifier. The loudspeaker provides an effective low-pass filter and recreates the analogue waveform accurately. However, the 1-bit approach has advantages over a PWM Class D amplifier, as a lower clock is required, though to make the power stage efficient, it is desirable in practice to reduce the average number of output transitions per second, as described, for example, in "Sigma-Delta Modulation in Digital Class-D Power Amplifiers: Methods for reducing the effective pulse transition rate"; R. Esslinger, G Gruhler, and R. W. Stewart; Audio Engineering Society $112^{th}$ Convention, Munich, May 10-13, 2002, and the invention envisages the incorporation, into an ambient noise-reduction system of the kind described herein, of a circuit to implement such a method.

Furthermore, the implementation of a 1-bit digital processor requires fewer logic gates than a processor with a 16-bit or higher word size. In particular, a 1-bit processor can be implemented without using any multipliers, reducing gate count considerably in a hardware design. The delta-sigma modulators, being only part of a conventional delta-sigma ADC and DAC, are cheaper to implement than the conventional converters.

The present invention provides an ambient noise-reduction system affording a higher degree of noise reduction than has hitherto been possible, through the use of a low latency signal processing chain consisting of analogue-to-digital conversion, digital processing and digital-to-analogue conversion. All the advantages of digital processing described above are obtained without incurring the group delay that rules out conventional digital processing. Specifically, it becomes possible to implement the required amplitude and phase response much more accurately than is possible with practical analogue circuits. Furthermore, adjustment of the group delay can readily be achieved, in units of a fraction of a micro-second, providing the ability to fine tune the group delay for feed-forward applications.

This is achieved by applying processing techniques using only a few bits to the electronic filter, i.e. by using a reduced number of bits (preferably in the range from 1 to 5 inclusive) in the audio sample, and an increased sample rate, compared to conventional digital processing techniques. In the extreme, it is possible to use 1-bit audio samples, and the following description will be presented for that example case, although the principles are equally valid for other numbers of bits per sample.

The inventor has determined that the 1-bit processing technique has a very low group delay, a characteristic that is not of significant benefit in most applications. The reason for the low delay is that the cause of the delays in delta-sigma converters is primarily the decimating and interpolating filters which, as described above, are omitted from this configuration; the delta-sigma modulators being responsible for very little delay. The inventor has also determined that it is possible to perform the required electronic filtering directly on the 1-bit signal.

The low delay times associated with 1-bit (or, in general, N-bit, where N is no greater than 8) processing are of crucial value to noise reduction, and the use of such processing solves the fundamental delay problem that has, until now, prevented the use of digital processing in this context.

This embodiment of the invention thus applies N-bit, and preferably 1-bit, processing principles to noise reduction, in order to obtain the advantages of digital processing without incurring the unacceptable group delay that rules out conventional digital processing.

The group delay of a typical delta-sigma Modulator is only a few clock cycles, and the delay of a suitable typical 1-bit processor is of the order of 10-20 clock cycles. Crucially, however, all of these delays are measured in clock cycles at the over-sampling rate, which is typically 64 times an audio sample rate of 48 kHz, i.e. around 3 MHz; equating to a clock cycle of only 0.33 micro-seconds. The entire 1-bit electronic filter can therefore have a group delay of 10 micro-seconds or less; well within the above-exemplified target of 40 micro-seconds for a feed-forward arrangement.

Figure 8:
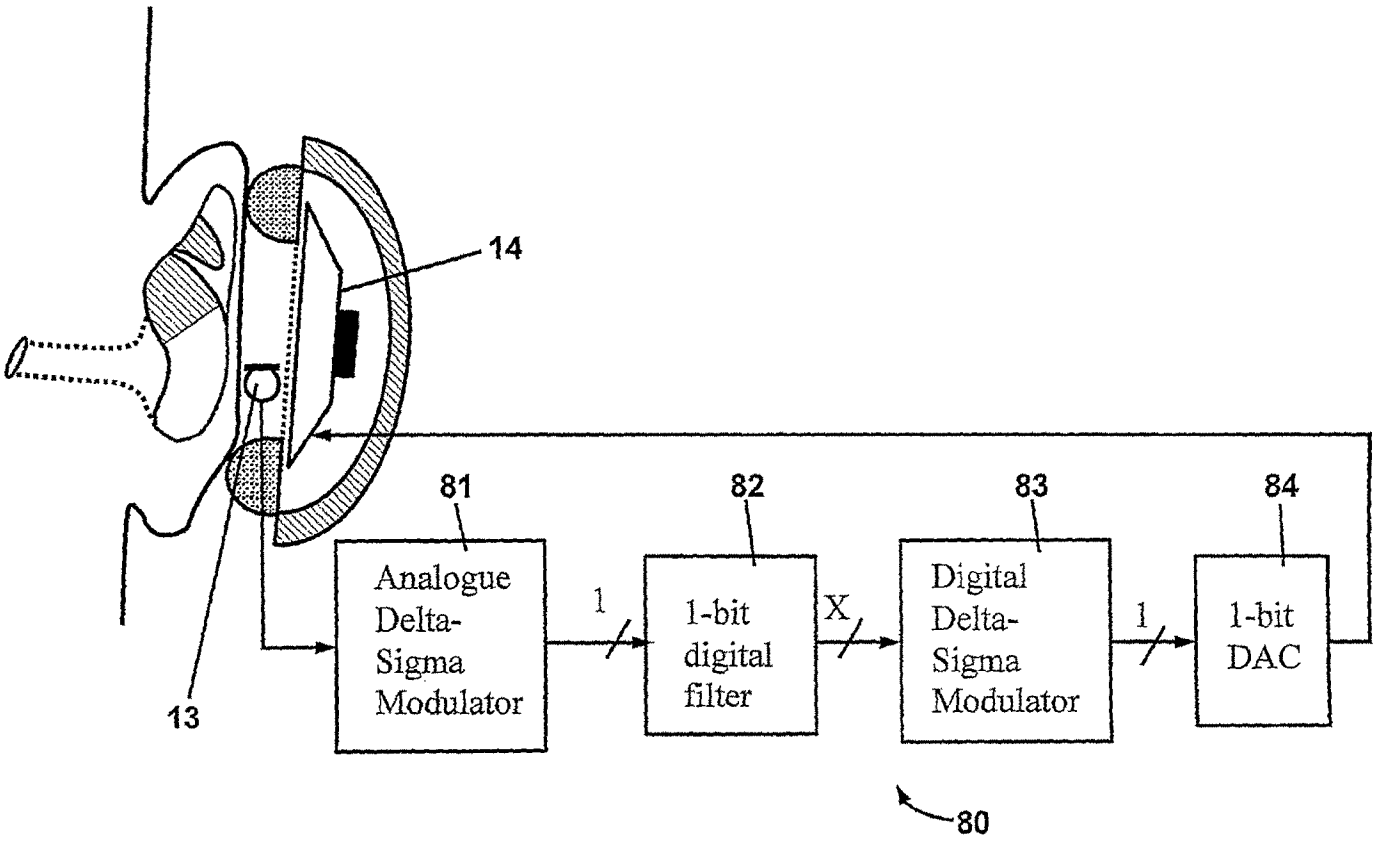
FIG. 8 shows, in schematic form, a circuit arrangement in accordance with one embodiment of the invention.
Figure 9:
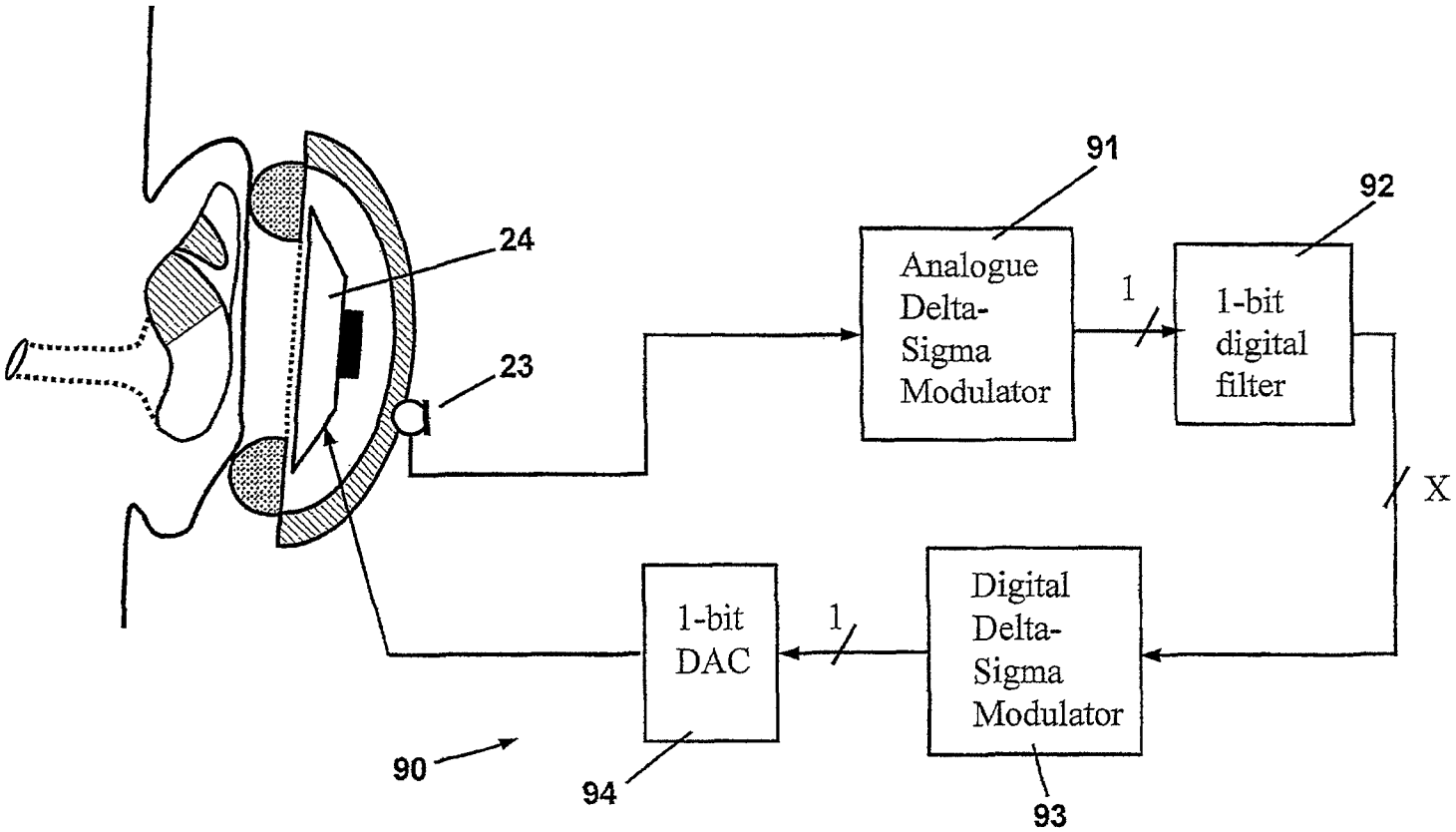
FIG. 9 shows, in schematic form, a circuit arrangement in accordance with another embodiment of the invention.

FIG. 8 shows an embodiment of the invention for the feed-forward arrangement, and FIG. 9 shows one for the feedback arrangement. It will be appreciated that inputs for music or other signals intended for the listener's attention can be provided in either embodiment, and coupled into any convenient point in the circuit.

Figure 1A:
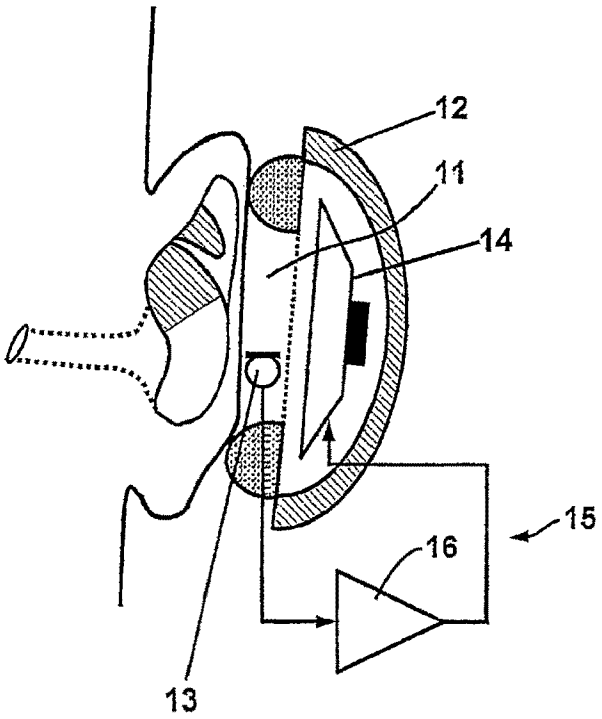
Fig 1a PRIOR ART
Figure 2:
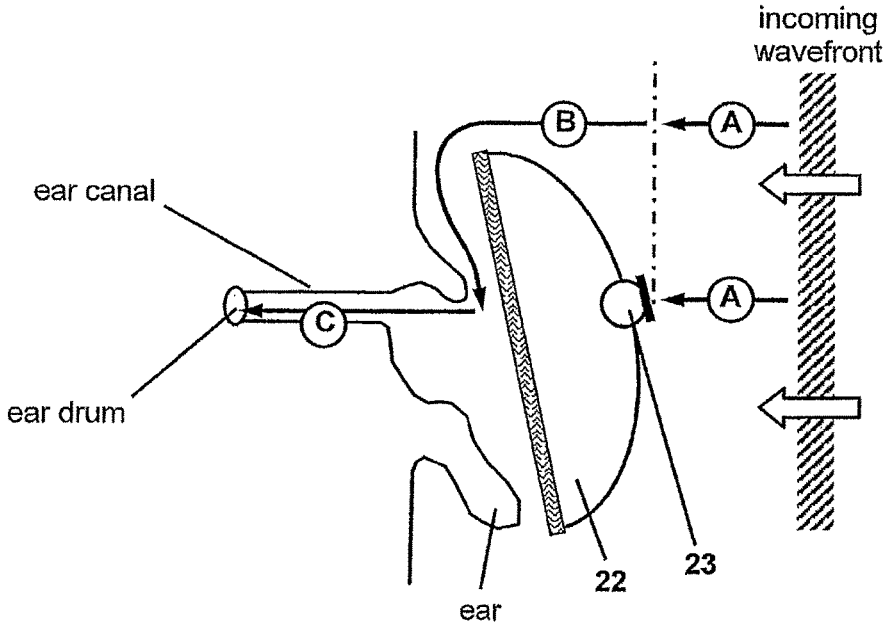

Referring now to FIG. 8, in which components common to FIG. 1*a* carry the same reference numbers, the microphone 13 feeds the loudspeaker 14 by way of a digital processing chain 80, comprising the series connection of an analogue delta-sigma modulator 81, a 1-bit digital filter 82, a digital delta-sigma modulator 83 and a 1-bit DAC 84 which is configured to drive the loudspeaker 14 directly from its output; making it possible to use the Class D principles described above.

FIG. 9 shows an embodiment of the invention as applied to a feed-forward system and, accordingly, components common to FIG. 1*b* carry the same reference numbers. In FIG. 9, the feed-forward path from the microphone 23 to the loudspeaker 24 is via a digital processing path 90 comprising an analogue delta-sigma modulator 91, a 1-bit digital filter 92, a digital delta-sigma modulator 93 and a 1-bit DAC 94.

Each of the functional units of FIGS. 8 and 9 will now be described in detail.

Figure 10:
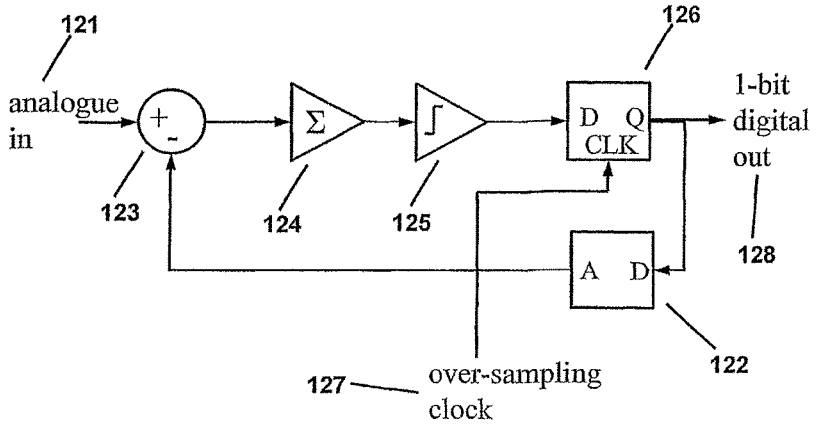
FIG. 10 shows a typical first-order analogue delta-sigma modulator usable with the invention.

The internal architecture of a typical analogue delta-sigma modulator 81, 91 is shown in FIG. 10. The analogue difference between an input 121 and the output of a 1-bit DAC 122 is formed by a subtractor 123, and is integrated over time by an integrator 124. The output of this integrator is compared to a reference level in a comparator 125, this performing conversion from the analogue domain to the digital domain. The output of comparator 125 is clocked into a D-type latch 126 under the control of an over-sampling clock (not shown) which applies clocking pulses over a connection 127. The output of the latch 126 is the 1-bit output signal 128 of the delta-sigma modulator, provided on an output line 128. The 1-bit output from latch 126 is also fed into the 1-bit DAC 122 to complete the feedback loop. This circuit is called a "first-order" delta-sigma modulator because it has one integrator stage.

A basic understanding of the operation of this circuit can be obtained by appreciating that the output of the subtractor 123 represents the error between the analogue input 121 and the 1-bit digital output on line 128, as fed back through DAC 122. This error is positive if the output on line 128 is a logic '0', and is negative if the output on line 128 is a logic '1'.

This error causes the output of the integrator 124 to increase if the input 121 is greater than the output on line 128, or to decrease if the input is smaller than the output. When the output of the integrator 124 crosses the threshold level applied to the comparator 125, the output of comparator 125 switches state; a logic '1' indicating that the input 121 is greater than output on line 128, and a logic '0' indicating that the input is less than the output. On the next edge of the clock pulses applied on line 127, D-type latch 126 will therefore change output state; DAC 122 output and the output of subtractor 123 will both change sign; and the output of the integrator 124 will start changing in the opposite direction to previously. When the comparator threshold is again crossed, the next clock will cause the output to change state again and the cycle repeats.

The output therefore continually flips between logic '1' and '0', and it will be observed that the higher the input signal, the more time the output spends as a logic '1' compared to a logic '0'; and the lower the input signal, the more time the output spends as a logic '0' compared to a logic '1'. The output signal therefore represents the input signal, but contains a significant amount of high-frequency noise caused by the rapid switching of the output.

To understand how this signal is a useful representation of the input, and why the high frequency noise is not a problem, it is necessary to consider the signals in the frequency domain. The circuit of FIG. 10 is, as mentioned previously, known as a first-order delta-sigma modulator because there is one integrator in the loop. The integrator has the effect of distributing the noise towards the higher frequency end of the spectrum but, because the clock used runs at a frequency many times greater than the audio bandwidth, most of the noise is pushed outside the audio band. It is therefore possible to low-pass filter the 1-bit signal and re-create the audio with an acceptable signal-to-noise ratio. One such simple low-pass filter is that inherent in a typical electromechanical loudspeaker, which has a decreasing sensitivity with increasing frequency. It is therefore possible to feed the 1-bit signal directly to a loudspeaker to re-create the original audio.

Figure 11:
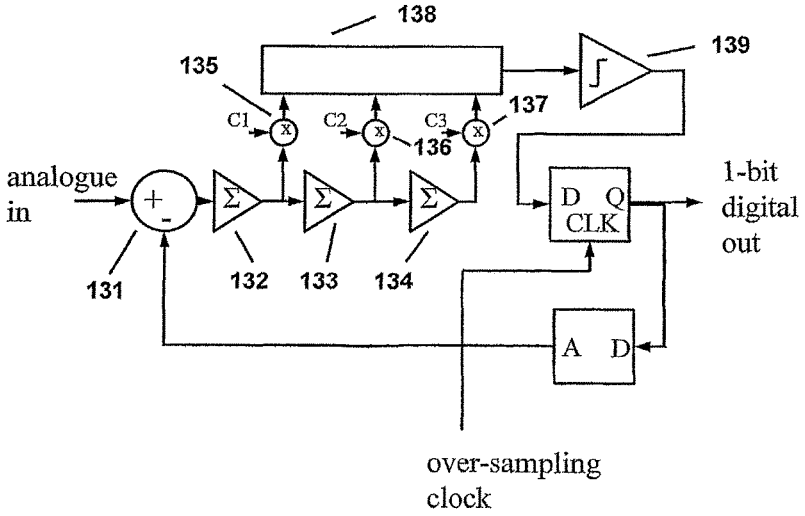
FIG. 11 shows, for comparison with FIG. 10, a typical third-order analogue delta-sigma modulator usable with the invention.

In practice, higher order delta-sigma modulators are commonly used, typically up to $5^{th}$ order, in order to move even more of the noise outside the audio band. FIG. 11 shows an example 3rd order delta-sigma modulator, in which a subtractor 131 performs the same function as subtractor 123 in FIG. 10. The output of the subtractor 131 is fed to a chain of three integrators 132, 133 and 134. The outputs of these integrators are multiplied by coefficients C1, C2 and C3 respectively in multipliers 135, 136 and 137, and mixed in a summer 138. The output of the summer 138 is fed into a comparator 139, which performs the same function as comparator 125 in FIG. 10. The remainder of the circuit is the same as FIG. 10. The action of combining the outputs of the integrators in this way forms an analogue filter which defines the way that the noise is distributed across the spectrum. Such a filter is usually referred to as a "noise-shaping" filter, for this reason.

In the embodiments of the invention shown in both FIGS. 8 and 9, the group delay can easily be adjusted in the 1-bit processor 82, 92 in increments of one sample at the over-sampling rate (for example 0.33 micro-seconds) using conventional techniques involving shift registers, memories or chains of flip-flops, for example. This facility is of particular benefit in relation to the embodiment shown in FIG. 9, as it permits fine tuning of the group delay time, which is particularly beneficial in feed-forward systems.

Common signal processing operations in a 1-bit processor result in an increase in the number of bits from input to output. FIGS. 7, 8 and 9 show the increased number of bits as a value "X". It is necessary to convert back to a 1-bit format before sending the signal to the 1-bit DAC 84, 94, and this is the function of the digital delta-sigma modulator 83, 93.

Figure 12:
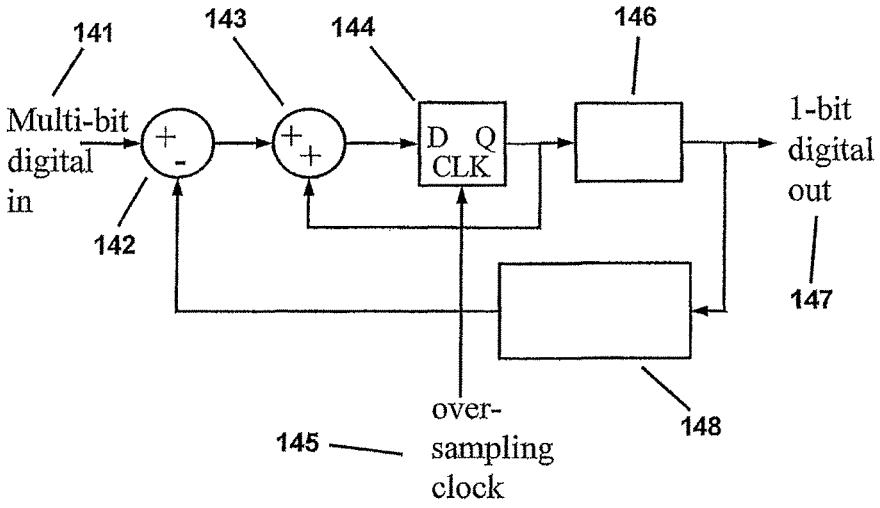
FIG. 12 shows a typical first-order digital delta-sigma modulator usable with the invention.

The function of the digital delta-sigma modulator is now described in further detail. The internal architecture of a typical digital delta-sigma modulator 83, 93 in FIGS. 8 and 9 is shown in FIG. 12. Similarities to the analogue delta-sigma modulator will be observed. The input 141, a multi-bit digital signal, is fed into a subtractor 142, whose other input comes from a feedback loop that is described below. The output of the subtractor 142 is fed into an adder 143, which in turn feeds a latch 144, which is clocked by over-sampling clock pulses applied on a line 145. The output of the latch 144 is fed back into the adder 143. The combination of adder 143 and latch 144 forms an integrator, equivalent to the integrator 124 in FIG. 10, The Most Significant Bit (MSB) extractor indicated at 146 is the equivalent to the comparator 125 of FIG. 10, and effects a trivial operation that converts the signal from a multi-bit digital signal into a 1-bit signal. The output of MSB extractor 146 is the 1-bit output 147 of the delta-sigma modulator. The output of MSB extractor 146 is also fed into unit 148, which effects another trivial operation to convert the 1-bit signal into a two-level multi-bit digital signal to complete the feedback loop by connection into the subtractor 142. The converter unit 148 is the equivalent to the 1-bit DAC 122 of FIG. 10.

Figure 13:
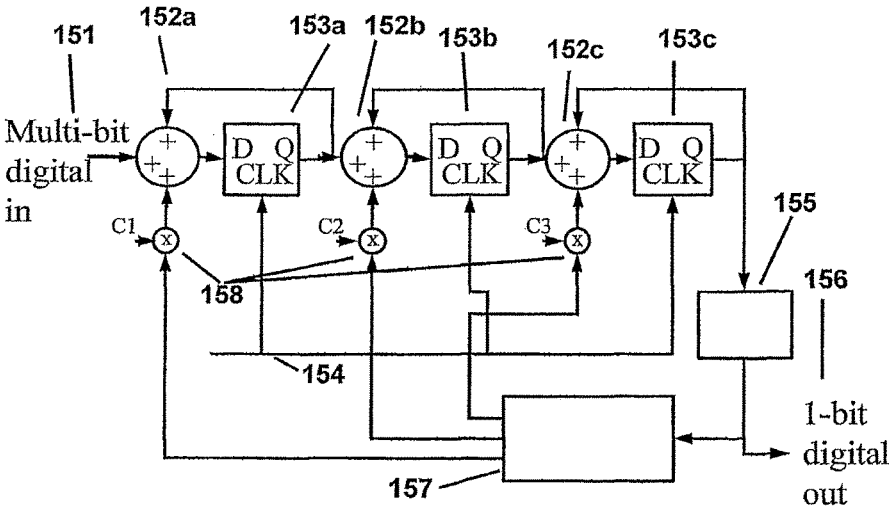
FIG. 13 shows, for comparison with FIG. 12, a typical third-order digital delta-sigma modulator usable with the invention.

The similarity of the digital and analogue versions of the delta-sigma modulator is clear, and it is commonplace to use higher order digital delta-sigma modulators in a similar way to that described above for analogue delta-sigma modulators, thus allowing a noise-shaping filter to be implemented. An example of a third order version is shown in FIG. 13.

Multi-bit digital input 151 is connected to a chain of three integrators, consisting of adders 152*a*, 152*b*, 152*c*, and latches 153*a*, 153*b*, 153*c*, clocked by over-sampling clock pulses applied over a line 154. The output of the final latch 153*c* is connected to an MSB extractor 155, which generates the 1-bit output 156 and also feeds back via level converter 157 and individual multipliers 158 to the adders 152.

The noise-shaping filter shape is determined by the multiplier coefficients C1, C2 and C3 In this respect, it should be noted that the multipliers can be implemented simply because the feedback data input is a two-state signal and therefore the output of each multiplier can only take one of two values, allowing it to be implemented as a sign switch on the coefficient value. This demonstrates one of the advantages of 1-bit processing.

Just as for the analogue delta-sigma modulator, the noise-shaping filter is an important part of the delta-sigma modulator. To convert a multi-bit digital signal into a 1-bit signal without using noise shaping would be equivalent to simply taking the most significant bit of the multi-bit signal as the 1-bit version. This would introduce noise across the whole frequency spectrum, including the audio band. The use of the noise-shaping filter within the delta-sigma modulator architecture allows the conversion from the multi-bit to the 1-bit domain to be performed without the introduction of excessive noise in the audio band. It is therefore essential, in this embodiment, that the digital delta-sigma modulator follows the 1-bit digital filter 82, 92 of FIGS. 8 and 9, as this is the only satisfactory way of converting from a multi-bit digital signal to a 1-bit digital signal.

The 1-bit DAC 84 and 94 perform simple operations designed to obtain an accurate analogue representation of the 1-bit digital signal. Although it is a simple function, it is well known that designers need to take care to ensure clean switching edges, stable voltage references levels and so on.

Figure 14:
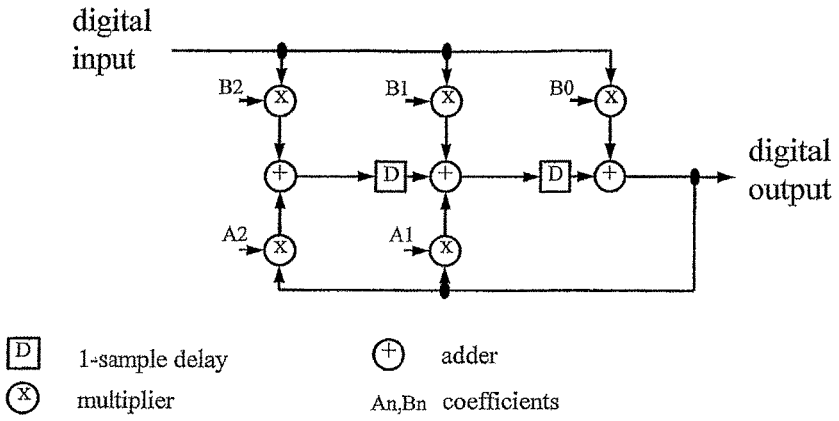
FIG. 14 shows a conventional second-order IIR filter usable with the invention.

The 1-bit filter 82, 92 can be designed using the same design principles as a conventional multi-bit digital filter, for example the second order IIR filter shown in FIG. 14. However, if the input is a 1-bit signal, the multipliers for the feed-forward coefficients (B0, B1 , B2 ) become simple sign switches. The feedback coefficient multipliers are full multi-bit multipliers, but coefficients can usually be selected to minimise the multiplier size.

It is of course possible to combine various elementary filters into a more complex arrangement in order to satisfy the filtering requirements.

Some simplification of the overall circuit is sometimes possible, by combining the functions of the 1-bit filter 82, 92 and the noise-shaping filter of the digital delta-sigma modulator 83, 93 into a single filter unit.

Figure 15:
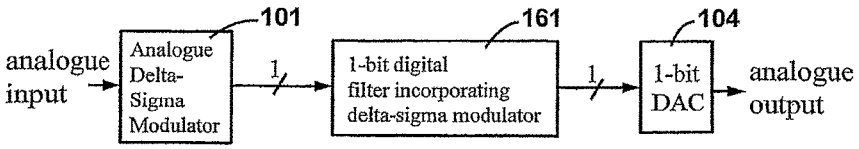
FIG. 15 shows a developed form of the invention, in which certain processing functions are merged.

FIG. 15 shows in outline such an arrangement, usable for either feedback or feed-forward systems, with the combined 1-bit digital filter and digital delta-sigma modulator being shown at 161. It will be understood that the combined filter and modulator 161 comprises in effect a combination of components 82 and 83 (FIG. 8) or 92 and 93 (FIG. 9).

It is also possible to split the combined filter and modulator 161 into two or more cascaded sections, each having its own delta-sigma modulator, so as to return to the 1-bit domain more than once.

The invention claimed is:

1. A listening device, comprising:

a loudspeaker, positioned to direct sound in a forward direction towards a listener;

a microphone, positioned in front of the loudspeaker, to detect sounds generated by the loudspeaker and ambient noise reaching the listener, wherein the microphone is adapted to generate an analog signal; and a noise reduction processing system, for generating a noise reduction output signal to be applied to the loudspeaker, in response to the analog signal, the system comprising:

an input, for receiving the analog signal;

an analog-digital converter, for generating a digital signal from the analog signal representing ambient noise;

a decimating filter, for generating a decimated digital signal from the digital signal generated by the analog-digital converter;

a digital signal processing filter, for receiving the decimated digital signal as an input, for filtering the decimated digital signal, and for outputting the filtered decimated digital signal as a noise cancellation signal;

an interpolating filter, for generating an interpolated noise cancellation signal from the noise cancellation signal; and a digital-analog converter for generating an output noise cancellation signal from the interpolated noise cancellation signal, wherein the digital-analog converter is coupled to the loudspeaker in order to supply the output noise cancellation signal to the loudspeaker.

2. A listening device according to claim 1, wherein the decimating filter comprises:

a low-pass filter; and a downsampler.

3. A listening device according to claim 1, wherein the interpolator comprises:

an upsampler; and a low-pass filter.

4. A listening device according to claim 1, wherein the analog-digital converter comprises a delta-sigma modulator.

5. A listening device according to claim 1, wherein the digital-analog converter comprises a delta-sigma modulator.

6. A listening device according to claim 5, wherein the digital-analog converter further comprises a 1-bit digital-analog converter connected to an output of the delta-sigma modulator.

* * * * *